US006185980B1

(12) United States Patent
Law

(10) Patent No.: US 6,185,980 B1
(45) Date of Patent: Feb. 13, 2001

(54) SPECIAL CRIMPING TOOL

(76) Inventor: Leonard J. Law, 1520 Palmer Dr., Laramie, WY (US) 82070

( * ) Notice: Under 35 U.S.C. 154(b), the term of this patent shall be extended for 0 days.

(21) Appl. No.: 09/404,487

(22) Filed: Sep. 23, 1999

(51) Int. Cl.[7] ..... B21D 7/06; B21F 45/00
(52) U.S. Cl. ..... 72/409.01; 29/268
(58) Field of Search ..... 72/409.19, 409.18, 72/409.01, 292; 81/3.44; 29/268

(56) References Cited

U.S. PATENT DOCUMENTS 410,606 * 9/1889 Patton ..... 72/409.19
431,086 * 7/1890 Traut ..... 81/3.44
601,230 * 3/1898 Billing ..... 72/409.19
1,429,452 * 9/1922 Phillips ..... 72/409.01
1,994,819 * 3/1935 Hartson ..... 81/3.44
2,691,909 * 10/1954 Hopmann ..... 81/3.44
5,697,135 * 12/1997 Dischler ..... 72/409.01
6,044,681 * 4/2000 Frenken ..... 72/292

* cited by examiner

*Primary Examiner*—Daniel C. Crane
(74) *Attorney, Agent, or Firm*—Morland C. Fischer

(57) ABSTRACT

A tool designed to perform the crimping of irregular shaped rings onto surfaces that are also potentially geometrically irregular. Because of the irregular shape of the crimping ring, special holding mechanisms and unique crimping ribs must be employed. A primary use of the subject invention is to field crimp a chain ring onto a cap chain utilized with installed fire hydrant caps.

14 Claims, 3 Drawing Sheets

SPECIAL CRIMPING TOOL

BACKGROUND OF INVENTION

FIELD OF INVENTION

The present invention relates to a crimping tool designed especially to operate in field use where the crimped ring principally has exceptional shape requirements. In particular this tool crimps a chain ring onto a cap chain utilized with installed fire hydrant caps.

BACKGROUND

Crimping tools have existed for many years. Most are of a general type that obtains sufficient mechanical advantage to perform the crimping operation by using long handles. Others are designed to work in small spaces by utilizing multiple short arms to obtain the needed mechanical advantage. Further the general crimping tool is designed to crimp onto a cylindrical surface, such as a small smooth pipe, with an original round oversized ring. In the subject case these regular conditions are absent and are replaced by special requirements built into the crimping surface during the original manufacturing process.

The subject invention primarily concerns fire hydrants or fireplugs that have been with civilization for decades. Early water mains were made of wood and so chopping into it when water was needed to fight a fire resulted in a plug being used to seal the leak. Thus the history of the name "fireplug." Iron and bronze fire hydrants have been manufactured for over a century and have been standardized for perhaps half that time. Today the hydrant pumper nozzle cap is of standard threaded size, refer to ASTM 126 CLB. When the cap is removed for use under hurried circumstances, it was often flung away and lost or damaged. To prevent this a chain was attached to the cap into order to allow it to hang near the base of the fire hydrant for easy retrieval. This chain is fixed to the cap with a chain ring, and a version of the subject invention crimps such specially made ring onto the cap and chain under field conditions. A good view of various fire hydrants with their pumper nozzle caps in place and each attached with the chain and ring is shown on the cover Internet page www.firehydrant.org.

Fire hydrants are made to last many years in all kinds of field use. However during this time a common maintenance item is the ring crimped to the nozzle caps and holding the retrieval chain in place. When replacement of the ring, and also often the chain, is required, field crimping of this ring is a common requirement since the ring and chain are easily ordered from the supplier. If the subject invention is ignored, then unfortunately no field-crimping tool is available to perform this task. Alternatively, the cap can be returned to the factory for such installation of a new ring and chain, but at great expense.

Generalizing this crimping tool design to other crimping operations requires crimping jaws or their equivalent having recesses, slots, or grooves that will fit any subject special ring that is desired to be crimped onto a curved geometric surface, and further insuring that the crimping tool surface is properly aligned.

U.S. Pat. No. 5,267,464 entitled "Pipe Ring Crimping Tool" discloses a standard type of crimping tool designed for pipe crimping of a smooth, regular ring, but with a series of short lever connections to obtain good mechanical advantage while using short handles that are ideal for use in confined spaces. Although the subject invention has a number of similar components, it is especially designed for crimping irregular rings onto unique curved surfaces, not common regular surfaces.

U.S. Pat. No. 5,609,080 entitled "Locking Pliers" discloses a type of vice-grip pliers with a locking, but not crimping, mechanism when closed, and in addition, an adjustable sized lower jaw. The subject invention being a type of tool with jaws has a number of similar components, but it is especially designed for crimping irregular rings onto unique curved surfaces, not clamping onto a regular surface.

SUMMARY OF INVENTION

The objectives of the present invention include overcoming the above-mentioned deficiencies in the prior art by designing a tool that allows the crimping of irregular shaped rings onto surfaces that are also potentially geometrically irregular. A primary use of the subject invention is to field attach a chain ring onto a cap chain utilized with installed fire hydrant caps.

BRIEF DESCRIPTION OF DRAWINGS

FIG. 3 shows a teardrop-shaped crimping ring used with fire hydrants.

DETAILED DESCRIPTION OF INVENTION

The present invention relates to a crimping tool designed especially to operate in field use where the crimped ring principally has exceptional shape requirements. A common use for this tool is to crimp a chain ring onto a cap chain utilized with installed fire hydrant caps. This is a field operation since fire hydrants exist in most cities and towns in the country. When a new fire hydrant is installed, it comes complete with the chain ring already crimped holding one end of the cap chain while the other end is fastened to the fire hydrant structure. The purpose is to not allow the nozzle cap to be lost in the helter-skelter operation of getting a fire hose hooked to a field fire hydrant in minimal time under high stress conditions.

This chain ring in the installed, crimped condition is quite visible on any well-maintained fire hydrant. It is not crimped tight but is loose enough to allow it to move around the nozzle cap on which it is crimped so that the chain may easily rotate in any direction. A good view of various fire hydrants with their pumper nozzle caps in place and each attached with the chain and ring is shown on the cover Internet page www.firehydrant.org.

This fire hydrant chain ring is of a general torus shape made of approximately quarter-inch steel rod, and when held up by the small end it resembles a teardrop-shape. It will be so designated as a teardrop-shaped ring for this application.

Figure 3A:
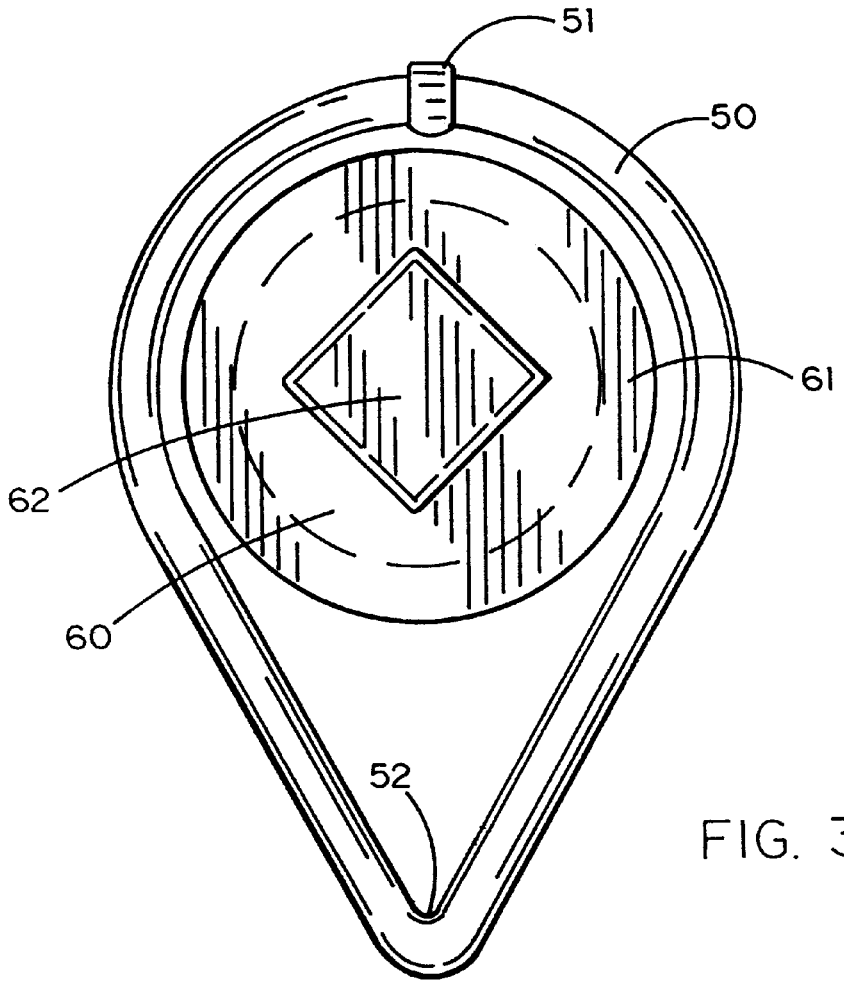
FIG. 3*a* shows an original ring placed around the pumper nozzle cap.

FIG. 3*a* shows this teardrop-shaped ring 50. This crimping ring is bent into this inverse teardrop-shaped and top-welded 51. The cap chain, not shown in FIG. 3*a*, when installed resides in the lower part 52 of the crimping ring. In FIG. 3*a* the crimping ring 50 is shown in the initial preinstalled position where it has just been placed around the nozzle cap 60 which is made with a recessed circular groove or slot 61 which the crimping ring fits into after the crimping operation is completed. The diamond shaped top 62 of the nozzle cap fits a wrench socket when unscrewed to attach a pumping fire hose.

Figure 3B:
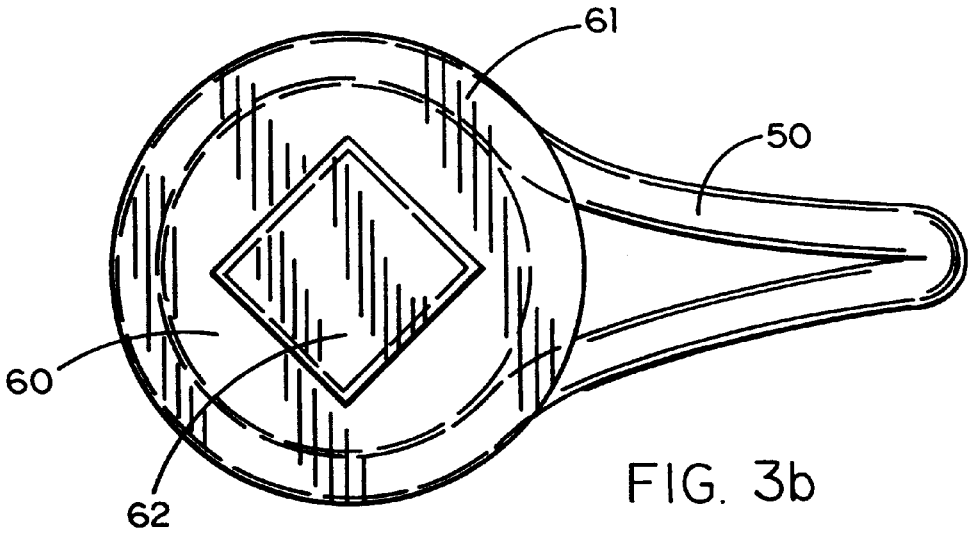
FIG. 3*b* shows the crimped ring around the pumper nozzle cap as a result of employing the subject special crimping tool.

FIG. 3*b* shows the result of ideally crimping the setup shown in FIG. 3*a* The ring 50 has been rotated a quarter of a turn, and now the crimping ring in its deformed, crimped state is substantially positioned into the recessed circular slot 61 of the nozzle cap 60. When the cap chain, not shown in FIG. 3*b*, is installed before crimping, it will further deform the crimped ring giving it an even more unsymmetrical shape.

Figure 1:
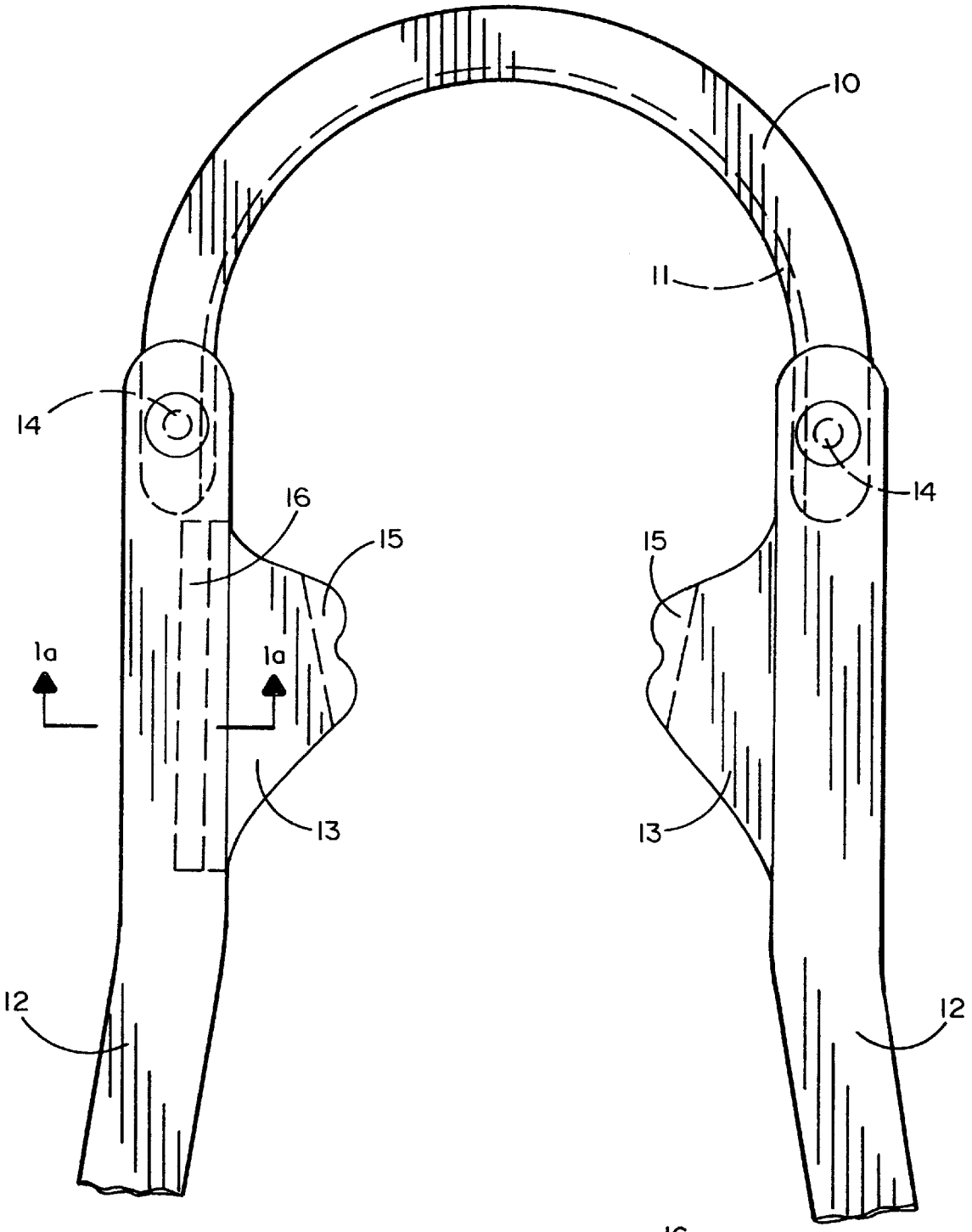
FIG. 1 shows a special crimping tool of an arch design where pivots needed for the crimping reside on the sides.

The crimping tool to perform such a crimping operation on this teardrop-shape must be specially designed to hold the crimping ring in place while pressure is exerted in the proper locations to deform the ring into its crimped profile. FIG. 1 shows one such design based upon using a semicircular structural arch 10 to hold the near circular portion of the teardrop-shaped ring with a recessed groove or slot 11, while having handles 12 containing crimping ribs 13 which then pivot 14 about the end arch positions. Additionally to keep the crimping ring from slipping under the pressure of crimping, recessed slots 15 are utilized in both crimping ribs 13. All the recessed slots are aligned in the same back to front position so that the crimping ring when inserted will be held in a consistent position substantially parallel to the plane of the crimping tool. This back to front position is selected to allow the necessary positioning of the crimping tool around the ring while the ring is further positioned around the object with which it is crimped.

This situation is shown in FIGS. 3*a* and 3*b* for the fire hydrant cap. Because the full nozzle cap—depending upon the particular fire hydrant, the screw cap part of the nozzle cap is at least twice the size of the crimping ring portion shown in FIGS. 3*a* and 3*b* blocks the crimping tool from any flexibility, all recessed slots are positioned as close to the back of the crimping tool as structural allowances will permit.

The material from which the crimping tool is made must be structurally able to perform the crimping operation without deformation of the tool. For the fire hydrant operation the crimping tool was conveniently cut from one-inch sheet steel, but other equivalent structural material is potentially usable.

Figure 1A:
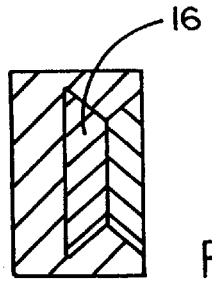
FIG. 1*a* is a cross-section taken along lines 1*a*—1*a* of FIG. 1.

The positioning of the ribs 13 as shown in FIG. 1 represents a compromise since they must be large enough to perform the necessary crimping operation; however, they must not require the handles to move too close together so that the operators hands come into contact. This can often be improved by slightly slanting outward the handles 12 as shown in FIG. 1. Further the ribs can be removable by utilizing a locking style, or tight sliding fit, beveled slot 16 to install them by slipping the appropriate sized rib into place. FIG. 1*a* shows such an optional installation for the ribs and allows the size of the ribs to be easily changed. Further multiple ribs are usable in this type of configuration so that various sizes of crimping rings are employable with one basic crimping tool.

Figure 2:
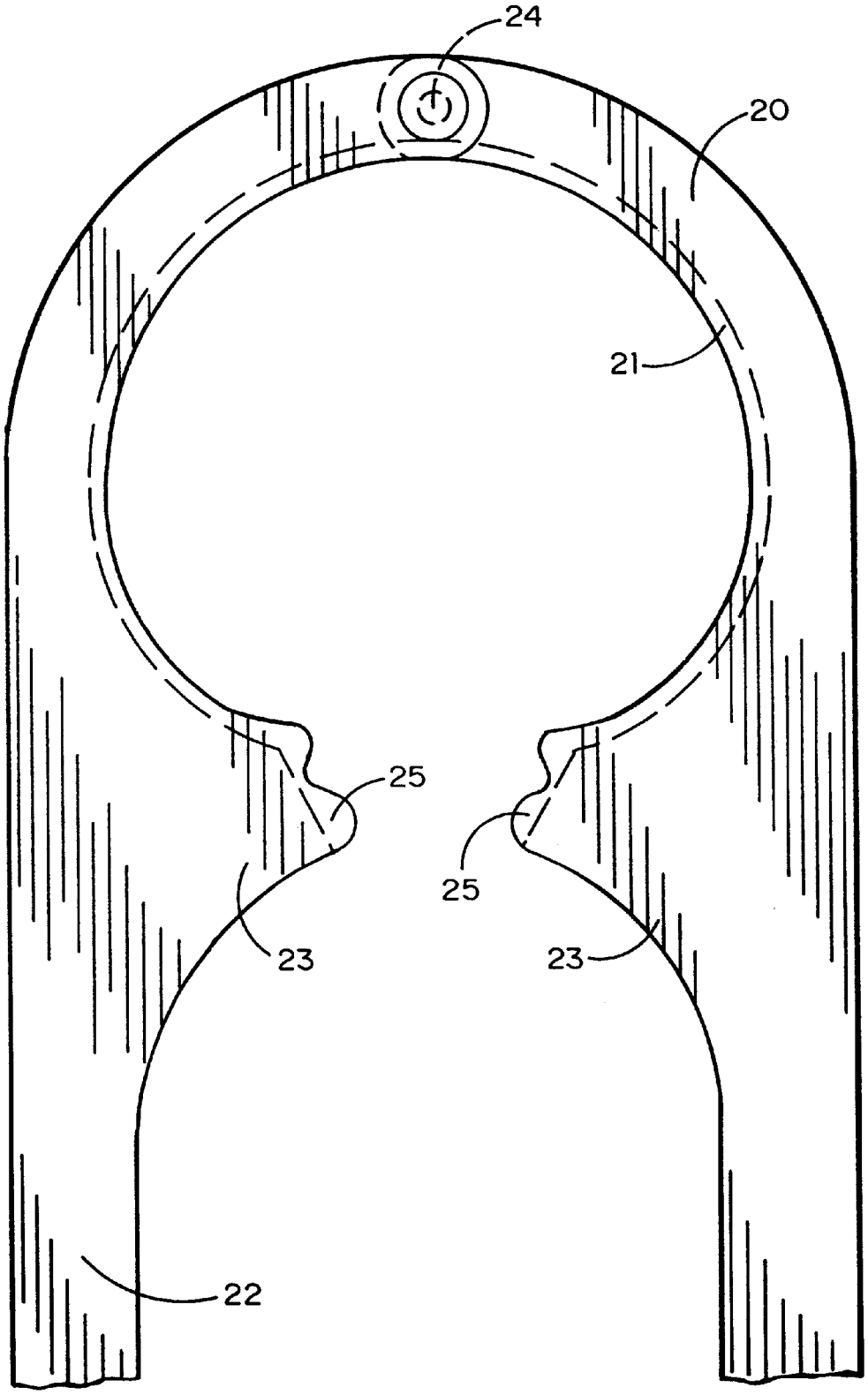
FIG. 2 shows a special crimping tool of jaw design where the single pivot is placed at the top of the jaws.

An alternate designed crimping tool is shown in FIG. 2. It is based upon a jaw operation where the pivot pin 24 is positioned at the top. With the two jaws together the upper part of the tool 20 is a semicircle for this design. However a larger curvature can be employed producing a substantial elliptical shape if the crimping ring required such a shape. As in FIG. 1, FIG. 2 employs a similar recessed groove or slot 21 to hold the ring while the tool is being placed around the object upon which it is crimped.

These recessed slots extend all the way around the jaws including the crimping ribs. All the recessed slots are aligned in the same back to front position so that the crimping ring when inserted will be held in a consistent position substantially parallel to the plane of the crimping tool. This back to front position is selected to allow the necessary positioning of the crimping tool around the ring while the ring is further positioned around the object upon which it is crimped.

Such a jaw-type arrangement, as shown in FIG. 2, for the crimping tool is especially useful for lighter crimping operations as well as ones in tight circumstances, since this jaw-type crimping tool is potentially made for one-handed operation For heavier jobs the arrangement of FIG. 1 with two pivot locations is preferred. The tool in FIG. 1 is utilizable in one-handed operation by arranging one of the handles to be firmly positioned on the ground while the other, moveable handle is operated. In case of a small person, this ground-held handle arrangement allows both hands to be placed upon the moveable handle for higher torque results. Further a one-armed disabled person can operate the tool in this manner.

Since the ring to be crimped is characterized by exceptional shape requirements, a wide range of non-standard crimping rings is possible. As noted the teardrop-shaped ring is one for which the subject invention is designed to handle. Yet there are many other crimping rings of exceptional shape requirements for which the tool described by the subject invention can potentially handle. In these unique applications of the subject invention, the crimping tool likely would be multiply employed upon a single ring.

A crimping tool has been described when referring to FIG. 1 for use with an irregular shaped ring comprising a first strut and a second strut connected by a structural arch pivotally connected to said first strut at a first pivot and pivotally connected to said second strut at a second pivot, wherein said arch and said first and second struts being movable between a ring accepting orientation and a ring crimping orientation. A plurality of crimping ribs are attached of various heights placed on an inner surface of said first strut and similarly said second strut, wherein said ribs are positioned in an opposite orientation on each strut, and wherein at said ring crimping orientation said ribs extend below a geometrically regular region of said ring and perform said ring crimping. A recessed slot is placed into said arch and said crimping ribs wherein said slot is sized to position said ring. Handles are attached to said struts, wherein permitting rotation of said first strut about said first pivot in a first rotational direction while simultaneously rotating said arch and said second strut about said second pivot in an opposite direction to obtain said ring crimping orientation. The first and second struts further comprise sufficient structural material to remain a fixed configuration while said ring is crimped. The geometrically regular region of said ring is often an arc of a circle so that the arch is of similar shape. The recessed groove or slot is restricted in its location by the shape of material said ring encompasses, that is, the slot location is often close to one side or the other of the arch because of hindering boundaries restricting the placement of the crimping tool. The plurality of crimping ribs are commonly two ribs on each strut allowing substantial crimping of the ring while still keeping the handles at a reasonable distance apart. Further the handles, which do not have to be the same length or the same shape, as attached to said struts are made to allow a wide range of persons to operate said tool.

A crimping tool for use with an irregular shaped ring comprising a pair of opposing jaws with a first fixed jaw and a second moving jaw pivotally connected to said first jaw at an upper pivot, wherein said jaws are movable between a ring accepting orientation and a ring crimping orientation. At least one crimping rib is positioned on the lower part of each jaw, wherein said rib contains a recessed slot, wherein during said ring crimping orientation said ribs extend below a substantially semi-circular region of said ring, and wherein the height of said rib is sufficient to substantially crimp said ring. A recessed slot is placed into each jaw along its arch and continuing along all ribs, wherein said slot is sized to position said ring. Handles are attached to said jaws at the lower boundary, wherein permitting rotation of said second jaw about said first pivot in a first rotational direction while simultaneously rotating said first jaw in an opposite direction to close said jaws. The handles as attached are of sufficient length and shape to allow a wide range of adults to operate said tool without undo physical stress. The recessed slot is often positioned in a non-symmetric location because of the restriction caused by the shape of material said ring encompasses; therefore, said slot is usually found near the edge of the jaws. The upper pivot is often a special pivoting mechanism that allows said jaws to remain in aligned orientation and conveniently can be an overlapping arrangement such as is found on a pair of common pliers.

A crimping tool has been described for use with a teardrop-shaped ring comprising a structural first strut and a structural second strut connecting a structural arch pivotally connected to said first strut at a first pivot and pivotally connected to said second strut at a second pivot, wherein said arch and said first and second struts being movable between a ring accepting orientation and a ring crimping orientation. Two crimping ribs attached on an inner surface of said first strut and similarly said second strut and sized are positioned to substantially crimp said ring in said ring crimping orientation. A recessed slot is placed into said arch, wherein said slot is sized to position said teardrop-shaped ring along its semicircular portion, and wherein said slot is located off center in order to configure to the limited space provided by the material said ring encompasses. A recessed slot is placed into said ribs, wherein said slot is positioned as a continuation of said slot placed into said arch, and wherein said slot is sized to align said teardrop-shaped ring during said ring crimping orientation. Handles are attached to said struts, wherein permitting rotation of said first strut about said first pivot in a first rotational direction while simultaneously rotating said second strut about said second pivot in an opposite direction to obtain said ring crimping orientation. Handles as attached to said jaws are of sufficient length and shape to allow a wide range of adults to operate said tool. Further said handles are potentially oriented in order to produce approximately 65 foot-pounds of crimping torque. The teardrop-shaped ring is a standard fire hydrant cap chain ring.

The foregoing description of the specific embodiments will so fully reveal the general nature of the invention that others can, by applying current knowledge, readily modify and/or adapt for various applications such specific embodiments without departing from generic concept, and therefore such adaptations or modifications are intended to be comprehended within the meaning and range of equivalents of the disclosed embodiments. It is to be understood that the phraseology or terminology herein is for the purpose of description and not of limitation.

I claim:

1. A crimping tool for crimping an irregular shaped ring having geometrically regular and irregular regions, said crimping tool comprising:

a first strut;

a second strut;

a structural arch pivotally connected to said first strut at a first pivot and pivotally connected to said second strut at a second pivot, wherein said arch and said first and second struts being movable between a ring accepting orientation and a ring crimping orientation;

means for removably attaching a crimping rib of various size along an inner surface of each of said first and second struts, wherein said ribs are positioned in opposite alignment on each strut, and wherein at said ring crimping orientation said ribs perform said ring crimping;

a recessed slot placed into said arch and said crimping ribs, wherein said slot is sized to position said ring; and handles attached to said struts for permitting rotation of said first strut about said first pivot in a first rotational direction while simultaneously rotating said arch and said second strut about said second pivot in an opposite direction to obtain said ring crimping orientation.

2. The tool according to claim 1 wherein said first and second struts further comprise sufficient structural material to remain a fixed configuration while said ring is crimped.

3. The tool according to claim 1 wherein said geometrically regular region of said ring further comprises an arc of a circle.

4. The tool according to claim 1 wherein said slot further comprises a location restricted by the shape of material said ring encompasses.

5. The tool according to claim 1 comprising two crimping ribs located along the inner surface of each of said first and second struts to perform the crimping of said ring.

6. The tool according to claim 1 wherein said handles attached to said struts are of sufficient length and shape to allow a wide range of adults to operate said tool.

7. A crimping tool for crimping an irregular shaped ring having a substantially semicircular region and an irregular region, said crimping tool comprising:

a pair of opposing jaws including a first jaw and a second jaw pivotally connected to said first jaw at an upper pivot, said jaws being movable between a ring accepting orientation and a ring crimping orientation;

a crimping rib positioned on a lower part of each jaw, wherein at said ring crimping orientation said ribs extend below the substantially semicircular region of said ring, and wherein the size of said rib is sufficient to substantially crimp said ring;

a recessed slot to position said ring, said slot extending continuously through each of said first and second jaws and said crimping ribs thereof so as to receive and hold therewith in the substantially semicircular and irregular regions of said ring; and handles attached to said jaws at the lower parts thereof, wherein permitting rotation of said second jaw about said upper pivot in a first rotational direction while simultaneously rotating said first jaw in an opposite direction to close said jaws.

8. The tool according to claim 7 wherein said handles attached to said jaw are of sufficient length and shape to allow a wide range of adults to operate said tool.

9. The tool according to claim 7 wherein said slot further comprises a location restricted by the shape of material said ring encompasses.

10. The tool according to claim 7 wherein said upper pivot further comprises a pivoting mechanism that allows said jaws to remain in aligned orientation.

11. A crimping tool for use with a teardrop-shaped ring having a semi-circular portion and a tapered portion, said tool comprising:

a structural first strut;

a structural second strut;

a structural arch pivotally connected to said first strut at a first pivot and pivotally connected to said second strut at a second pivot, wherein said arch and said first and second struts being movable between a ring accepting orientation and a ring crimping orientation;

a crimping rib attached on an inner surface of each of said first and second struts and sized and positioned to substantially crimp said ring in said ring crimping orientation;

a recessed slot placed into said arch, wherein said slot is sized to receive and hold said tear-drop shaped ring along its semi-circular portion and wherein said slot is located off-center relative to said arch;

a recessed slot placed into said ribs, wherein said slot is positioned as a continuation of said slot placed into said arch, and wherein said slot is sized to receive said tear-drop shaped ring along its tapered portion during said ring crimping orientation; and handles attached to said struts for permitting rotation of said first strut about said first pivot in a first rotational direction while simultaneously rotating said second strut about said second pivot in an opposite direction to obtain said ring crimping orientation.

12. The tool according to claim 11, wherein said handles attached to said struts are of sufficient length and shape to allow a wide range of adults to operate said tool.

13. The tool according to claim 11 wherein said handles attached to said struts are of sufficient length and shape to produce substantially 65 foot-pounds of crimping torque.

14. The tool according to claim 11 wherein said teardrop-shaped ring further comprises a standard fire hydrant cap chain ring.

* * * * *